US005326190A

United States Patent [19]

Beamer

[11] Patent Number: 5,326,190

[45] Date of Patent: Jul. 5, 1994

[54] METHOD AND APPARATUS FOR STABILIZING A TRENCH FORM DURING CONSTRUCTION

[75] Inventor: John V. Beamer, Atlanta, Ga.

[73] Assignee: Construction Casting Company, Atlanta, Ga.

[21] Appl. No.: 34,302

[22] Filed: Mar. 22, 1993

Related U.S. Application Data

[63] Continuation-in-part of Ser. No. 962,985, Oct. 16, 1992.

[51] Int. Cl.[5] ..... E02B 5/00

[52] U.S. Cl. ..... 405/119; 249/9; 404/2; 404/4; 405/118

[58] Field of Search ..... 405/118, 119, 121, 124, 405/125; 249/1, 3–9, 11, 207, 208, 209; 404/2, 4

[56] References Cited

U.S. PATENT DOCUMENTS

| | | | |
|---|---|---|---|
| 786,305 | 4/1905 | McIntyre . | |
| 1,274,618 | 8/1918 | Smith . | |
| 1,562,780 | 11/1925 | Mickelson . | |
| 1,566,319 | 12/1925 | Fischer | 404/74 |
| 1,700,889 | 2/1929 | Heltzel | 249/9 X |
| 2,102,528 | 12/1937 | Hall | 404/74 X |
| 2,554,522 | 5/1951 | Carter | 404/74 X |
| 2,843,913 | 7/1958 | Barron . | |
| 2,917,804 | 12/1959 | Barron . | |
| 3,207,465 | 9/1965 | Papin | 249/34 |
| 3,378,968 | 4/1968 | Shoemaker | 52/155 |
| 3,567,171 | 3/1971 | Slominski | 249/9 |
| 4,498,807 | 2/1985 | Kirkpatrick et al. | 405/43 |
| 4,787,773 | 11/1988 | Kehler | 405/118 |
| 4,840,515 | 6/1989 | Freese | 405/45 |
| 4,844,655 | 7/1989 | Aleshire | 405/118 |
| 4,878,782 | 11/1989 | Beattie et al. | 405/119 |
| 4,968,179 | 11/1990 | Frahm | 405/53 |
| 4,993,877 | 2/1991 | Beamer | 405/282 |
| 4,993,878 | 2/1991 | Beamer | 405/282 |
| 5,000,621 | 3/1991 | Beamer | 405/282 |

FOREIGN PATENT DOCUMENTS

3018331A1 5/1980 Fed. Rep. of Germany .

*Primary Examiner*—Dennis L. Taylor
*Attorney, Agent, or Firm*—Needle & Rosenberg

[57] ABSTRACT

A method and apparatus for forming a trench with grates or solid covers, comprising an outer shell which is disposed between opposed frame members at a certain position within a ditch and an inner core that is received within a channel in the shell. The core aids in providing rigidity to the shell while concrete hardens about the outer surface of the shell. Rods are vertically driven through the core and the outer shell into the bottom of the trench to stabilize the forms while the concrete or other setting material is poured into the trench. The rods are removed before the material hardens. After the encasing material sets, the core can be removed from the shell which then enables the shell to be more easily displaced from the formed trench.

6 Claims, 1 Drawing Sheet

METHOD AND APPARATUS FOR STABILIZING A TRENCH FORM DURING CONSTRUCTION

CROSS-REFERENCE TO RELATED APPLICATION

This is a continuation-in-part of pending application Ser. No. 962,985, filed Oct. 16, 1992.

BACKGROUND OF THE INVENTION

The present invention relates to the construction industry and more specifically to the formation of a trench with grates or solid covers.

In the prior art, a single piece pre-shaped form with a frame is used to form a trench with grates or solid covers. To form a relatively long trench, multiple trench form assemblies were laid in contiguous alignment end-to-end. Tape was placed at the adjacent ends so as to prevent upward seepage of concrete when the concrete or other material was poured into the trench and to connect one form to another. However, the use of tape did not provide adequate stabilization to prevent one form from getting out of alignment with another. The lack of adequate stabilization from form to form caused the system to come unconnected during the installation of the forms or to become misaligned during the pouring of the concrete.

In the prior art, the removal of the single piece trench form was very difficult due to the pressure of the surrounding concrete or other material which held the trench form very tightly in place. One would have to take the single piece trench form out in individual, small pieces or, in some instances, by pulling on a wire or wires or re-rod imbedded in the lower surfaces of the mold, thereby tearing through the mold to the top surface. This became a time consuming and frustrating procedure.

It can be seen that the prior system did not allow each trench form to be easily and economically connected to the next in such a way to strengthen the system as a whole so that it may be laid for great distances. It can also be seen that the method for removal of the single pre-formed form was frequently very difficult. The prior art system resulted in less than optimal form stability during the pouring of the concrete or other surrounding material and additional time was frequently required in the removal of the single pre-formed trench mold.

Therefore, there exists a need for an improved method for connecting one form to another form.

There also exists a need for improving stabilization of the entire trench form while in place, so not to get one trench form out of alignment with one another adjacent trench form.

There further exists a need for an improved method for removal of a pre-shaped trench form.

SUMMARY OF THE INVENTION

The disadvantages of the prior art are overcome by the present invention which relates to a novel method and apparatus for stabilizing a two or more piece pre-shaped form for forming with grates or solid covers.

A removable two or more piece pre-shaped mold for a grate-covered trench is held in a fixed position between two frames. The two or more piece pre-shaped mold for a trench with grates or solid covers is preferably made of expanded polystyrene, although other easily-shaped removable materials may be used. The form has a flat upper surface and a shaped lower surface. The shape of the lower surface is constructed to approximate the shape of the desired trench. The form typically extends the length of the frames but may be made in longer or shorter pieces.

The two or more piece pre-shaped form is made up of an outer shell or shells and an inner core or cores. A purpose of the inner core is to be able to remove it from the interior of the shell so that the outer shell's exterior walls and bottom wall will be more easily removed from the concrete surface or other surrounding materials surface.

The present embodiment provides a means for stabilizing or fixing the forms while pouring encasing material around them and includes a plurality of spaced-apart openings vertically formed through the inner core which are in alignment with openings disposed through the bottom of the outer shell. Rods are inserted through the respective openings in the core and the shell and are driven into the ground beneath the shell. The trench filling material is then poured into the trench until it is at a prescribed level relative to the sides of the outer shell. The rods are pulled out and the material is vibrated to fill in the holes left by the rods.

The trench form's outer shell and the inner core also greatly ease the removal of the trench form from the concrete or other materials surrounding it. Removal of the trench mold is simplified by removing one or more of the inner core pieces. For instance, the claw of a claw hammer, a crow bar, a pick or other device could be used to dig into the inner core pieces which easily lift out of each form, leaving the outer shell of the form. This releases the pressure of the concrete or other surrounding material. The outer shell's exterior walls may then be broken down into the cavity and the outer shell's bottom can be pulled up into and removed from the cavity with the simple use of the claw on the claw hammer, a crow bar, a pick or other device. The removal of the form from the trench would then be complete. The final product is a trench with grates or solid covers having the desired characteristics, and slope of the shaped form.

It can be seen, therefore, that it is an object of the present invention to provide an improved method of removal of a trench which is simple and quick.

It is an object of the present invention to provide a method and apparatus for fixing the form during pouring of concrete and the like.

BRIEF DESCRIPTION OF THE FIGURE OF THE DRAWING

FIG. 1 is an exploded perspective view of the inner core and shell of the present invention.

DETAILED DESCRIPTION OF THE PREFERRED EMBODIMENT

Figure 1:
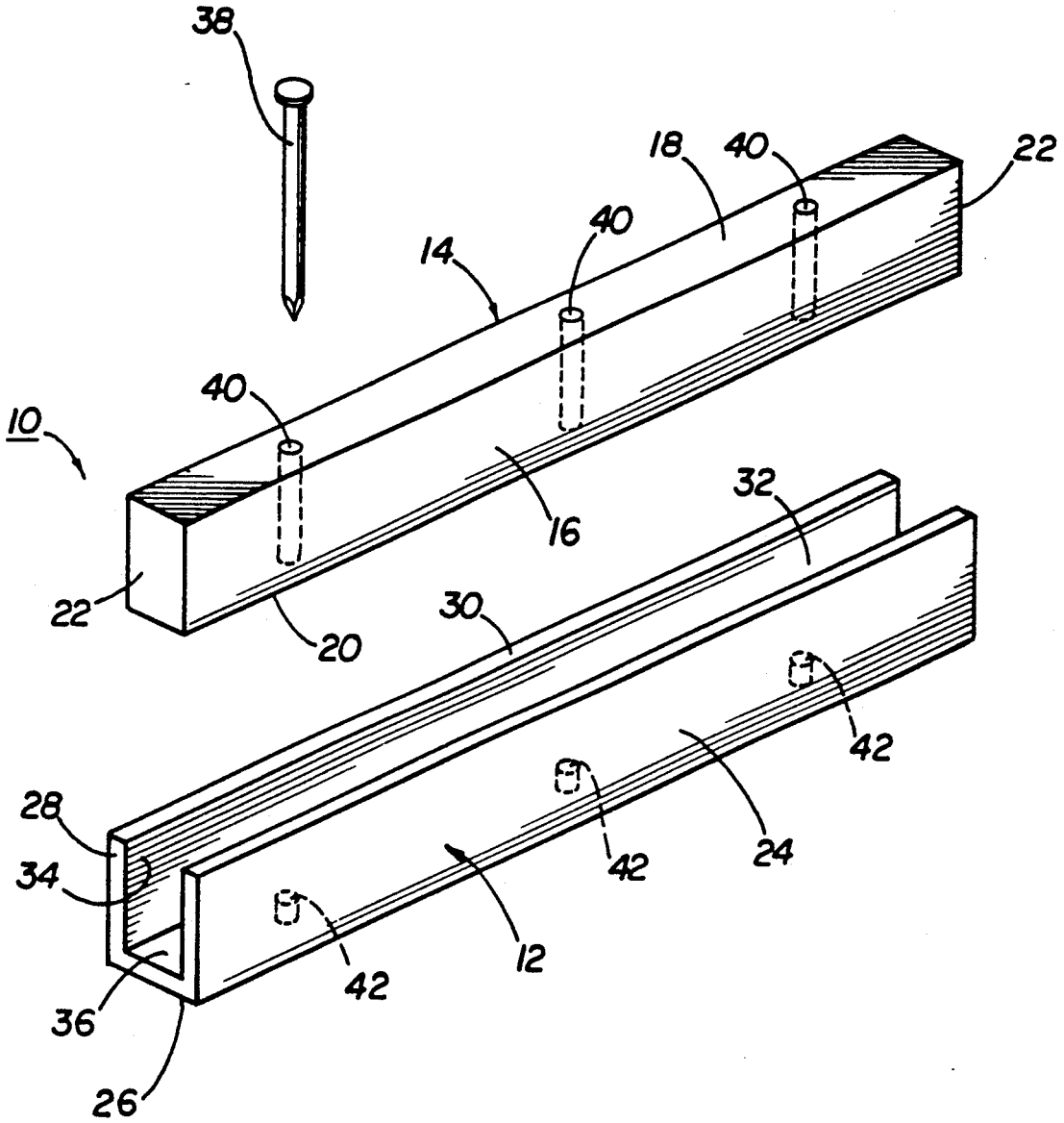

Referring to FIG. 1, the form 10 of the present invention is shown comprising an outer shell 12 and a removable core 14 which fits snugly inside, and is slidable within, shell 12. The core 14 has a substantially rectangular shape with upright, parallel side walls 16, flat top 18, opposed flat bottom 20 and upright opposed end walls 22.

The shell 12 comprises upstanding outer side walls 24, bottom 26, end walls 28, and top 30. A generally U-shaped channel 32, which opens through top 30 and end walls 28, longitudinally extends through shell 12, and is defined by interior side walls 34 and bottom surface 36. The channel 32 may have any desired shape but the cross-sectional shape of channel 32 should be complimentary to core 14. In one embodiment (not shown), the bottom of the channel 32 may actually extend through the bottom 26 of the shell 12. It is preferable, but not necessary, that the top 18 of the core 14 be flush with the top 30 of the shell 12 when the core 14 is inserted within the shell 12. The core 14 can be constructed of a material having a density which is lighter, heavier, or the same as the material for the shell 12, such as expanded polystyrene. It is understood that the bottom 26 of the shell 12 may have any desired shape to conform to the interior of the trench that has been dug.

Various methods may be used to attach the form to the frame assemblies at the proper height. To illustrate one such method of the working environment of the present invention 10, reference is made to U.S. Pat. No. 4,993,878 issued on Feb. 19, 1991 and the removable form 142 disclosed therein. The form 10 made up of the shell 12 and the core 14 will be positioned between a pair of frame assemblies (not shown) that have been positioned by any suitable means relative to the ground after a ditch of the proper depth has been dug. Thus, means (not shown) are provided on the form 10 so that it can be fixed to the frame assemblies at the proper height within the ditch. Other methods may or may not include provisions on the form for attachment to the frame. For example, a wire or other materials may be simply wrapped around the frames and under or through the form 10. These examples show various, but by no means all, of the methods of attachment of the form 10 to the frames.

When the forms 10 are narrow and/or deep, there is a tendency for them to move off center during the pouring of the concrete or like material therearound. The forms 10 may be stabilized during pouring by providing means for temporarily fixing the location of the shell 12 within the trench during the pouring step and removing the fixing means before the poured material hardens.

As seen in FIG. 1, the fixing means comprises a plurality of rods 38 (only one of which is shown for clarity) which are inserted through respective openings 40 vertically disposed through the core 14 and aligned openings 42 formed through the shell 12. The openings 40, 42 are shown to be evenly spaced apart along the center axis of the core 14 and the shell 12. The rods 38 are of sufficient length that they may be driven into the bottom of the trench dug for the form 10 and still extend above tops 18, 30.

In the embodiment (not shown) wherein the core extends through the bottom of the shell, the fixing means comprises a plurality of rods which are inserted into openings that vertically extend through the core and which penetrate the bottom of the trench.

The concrete or other material is poured into the trench until it extends approximately 2–3 inches up the sides 24 of the outer shell 12. The concrete may then be vibrated to settle it. The rods 38 are pulled out of the openings 40, 42 and the concrete is again vibrated to fill in the holes in the concrete and the bottom of the trench left by the rods 38. Additional concrete may then be poured into the trench adjacent the side walls 24 until it reaches the top 30. The surface of the concrete is then finished off.

After the concrete or other encasing material hardens, the form 10 is removed therefrom in two steps. First, core 14 is removed using claws on a hammer, a crow bar, a pick or other device which will pull or pick out core 14 from shell 12. When this is accomplished, outer shell 12 can then be removed by collapsing inwardly the outer shell walls 24 into the channel 32. Again, the use of claws on a hammer, a crow bar, a pick or other suitable device will be used to remove shell 12 so as to form a clean trench.

What I claim is:

1. An improved trench form for shaping a trench of the type wherein the form is disposed within a ditch between two frame assemblies, concrete is poured within the ditch to encase the outer surface of the trench form and, after the concrete or other encasing material hardens, the form is removed, the improvement comprising:

(a) an elongated, rigid outer shell having upright opposed side walls, a forward end wall and an opposite rear end wall, a top wall and a bottom and having a channel longitudinally extending therethrough which is open through the end walls and the tope walls; and (b) a core that is positioned within and is removable from the channel and having opposed ends, a top and a bottom surface and a shape which is complimentary to the shape of the channel, whereby, after the concrete hardens, the core is removed from the shell and then the shell is removed from the concrete; and (c) means for fixing the position of the shell and the core relative to the trench while the concrete is poured within the ditch, the fixing means being removable from the core and the shell after the concrete is poured.

2. An improved trench form as claimed in claim 1 wherein said fixing means comprises the shell having a first opening vertically disposed through its bottom, the core having a second opening vertically extending therethrough in registry with the first opening and a rod received within the openings and being of a length to extend into the bottom of the trench whereby, prior to the hardening of the concrete, the rod is removed from the trench and the form.

3. An improved trench form as claimed in claim 1, wherein the channel vertically extends through a portion of the bottom of the shell and wherein the fixing means comprises an opening vertically disposed through the core and a rod received within the opening and being of a length to extend into the bottom of the trench whereby, prior to the hardening of the concrete, the rod is removed from the trench and the form.

4. A method of making a trench, comprising the steps of:

(a) forming a ditch in the ground;

(b) fixing at a preselected depth within the ditch a trench form comprising an outer shell and a core received within a channel longitudinally extending through the shell;

(c) inserting a rod vertically through the core and the shell with the bottom portion thereof extending into the bottom of the trench;

(d) pouring concrete or other encasing material into the trench until the material rises to a predetermined level therein;

(e) prior to the setting of the concrete, removing the rod from the shell and the core; and (f) pouring concrete or other enclosing material into the trench until it reaches to the top of each frame and is finished.

5. A method of making a trench as claimed in claim 4, and further comprising the step of vibrating the encasing material after the pouring step and after the removing step.

6. A method of making a trench as claimed in claim 5 and further comprising the steps of adding additional concrete after the removing step into the ditch until it reaches the top of the trench form and finishing off the concrete.

* * * * *